US005097776A

United States Patent [19]

Becker

[11] Patent Number: 5,097,776

[45] Date of Patent: Mar. 24, 1992

[54] METHOD AND APPARATUS FOR LOADING AND TRANSFERRING MATERIALS IN A SEWING SYSTEM

[75] Inventor: Daniel Becker, Hopkinsville, Ky.

[73] Assignee: Juki America, Inc., Duluth, Ga.

[21] Appl. No.: 525,898

[22] Filed: May 18, 1990

[51] Int. Cl.[5] ..... D05B 27/00

[52] U.S. Cl. ..... 112/303; 112/311

[58] Field of Search ..... 112/303, 304, 305, 306, 112/311, 121.12, 121.15

[56] References Cited

U.S. PATENT DOCUMENTS

| | | | |
|---|---|---|---|
| 1,942,128 | 1/1934 | Sommer | 112/303 |
| 3,332,377 | 7/1967 | Emslie et al. | 112/303 |
| 3,334,600 | 8/1967 | Conner, Jr. | 112/303 |
| 4,173,191 | 11/1979 | Taddicken | 112/311 |
| 4,481,895 | 11/1984 | Asao et al. | 112/311 |
| 4,590,876 | 5/1986 | Mencke et al. | 112/306 |
| 4,608,936 | 9/1986 | Ball et al. | 112/306 |
| 4,621,585 | 11/1986 | Ball et al. | 112/304 |
| 4,669,400 | 6/1987 | Michaels et al. | 112/305 |
| 4,768,451 | 9/1988 | Spencer, III | 112/306 |

FOREIGN PATENT DOCUMENTS

| | | | |
|---|---|---|---|
| 1-91895 | 4/1989 | Japan | 112/303 |
| 2115026 | 9/1983 | United Kingdom | 112/311 |

*Primary Examiner*—Werner H. Schroeder
*Assistant Examiner*—Ismael Izaguirre
*Attorney, Agent, or Firm*—Morgan & Finnegan

[57] ABSTRACT

A method and an apparatus for loading and transferring material in order to transport the material from a loading location through a sewing machine is provided. The invention reduces the cycle time between the loading of materials by allowing the operator to load one material while a previously loaded material is in the sewing process. The use of clamps during the loading, transporting, and sewing procedures ensures that the stitching will be accurately located and the material will be in the desired configuration.

5 Claims, 3 Drawing Sheets

METHOD AND APPARATUS FOR LOADING AND TRANSFERRING MATERIALS IN A SEWING SYSTEM

FIELD OF THE INVENTION

This invention relates generally to sewing machine systems. More particularly, the invention relates to a method and an apparatus for transporting a workpiece between work stations during a sewing operation.

BACKGROUND OF THE INVENTION

The transportation of a workpiece is a common problem in industrial sewing operations. There are situations where the arrangement of the workpiece must be maintained during the transportation of the workpiece to the sewing operation. When the arrangement is altered, the resulting product could have inaccurate stitching and the sewing operation may have to be repeated or the product may have to be scrapped.

The sewing operation of any garment, e.g., shirts, skirts, pants, benefits from precise transportation of the workpiece, in the desired arrangement, to and through the sewing machines. However, there are many situations where the maintenance of the arrangement of the workpiece is critical. For example, in the production of yoke-back panel assemblies, especially when there is a pleat in the back panel material, it is necessary for the operator to first configure the material in the correct arrangement and then hold the arrangement in place while the material is fed through a sewing machine.

The conventional technology used to sew workpieces involves the use of a single clamp system. After the workpiece has been configured, the materials are clamped in place and the materials are carried through a sewing machine. After the sewing process is complete, the material is released and the clamping mechanism is returned to its initial position to be reloaded. The operator is forced to wait for sewing of the clamped workpiece to finish and for the clamping mechanism to return to the loading position before loading the next material.

This delay causes a loss of potential productive time while the operator waits for the return of the clamping mechanism. The travel time and the time needed to conduct the sewing process constitute an unacceptable loss of time when the operator can only sit and wait for the return of the clamping mechanism.

In particular because of the need for accuracy in the alignment of yoke-back panel materials during the sewing process, especially when there are pleats in the back panel material, it is necessary for the yoke-back panel assembly to be maintained in a consistent alignment from the time the panels are arranged to the time the sewing process is complete. This alignment must also be maintained as the panel materials are passed through the sewing machine at the speed necessary to accomplish the correct type and quality of stitching.

Assembly and other sewing functions also present alignment and transportation problems. Thus, a generally applicable system for securing a first material orientation, and transporting the material to a different location for sewing, has been sought to relieve the operator of continuous hands-on operation.

Accordingly, it is an object of the present invention to provide a fast, accurate, consistent, and relatively simple means of moving and transferring materials from one clamping transporter to another without disturbing the configuration of the materials.

It is a further object of the present invention to provide interacting transfer assemblies to enable an operator to load one assembly while the other is passing a workpiece through a sewing machine.

It is also an object of the invention to provide a system where the transfer mechanisms, while interacting, are capable of operating independently to allow the operator flexibility in timing.

SUMMARY OF THE INVENTION

The above-mentioned and other objects of the invention are met by a loading and transferring method and apparatus according to the present invention. In a method aspect, the invention includes the steps of securing the material to be moved in a clamp at a loading position; maneuvering the loading clamp toward the place where the transfer will take place; simultaneously maneuvering a second, sewing clamp to the transfer position; transferring control of the workpiece from the loading clamp to the sewing clamp; and then moving the loading clamp and the sewing clamp in opposing directions (the loading clamp returns to the loading position and the sewing clamp is maneuvered to pass the secured material through a sewing machine in synchronized motion with the speed of the sewing machine).

In an apparatus aspect, the invention includes a supporting structure, first and second clamps attached to the supporting structure, a mechanism for maneuvering the first clamp back and forth between the location where the workpiece is loaded to the location where the workpiece is transferred from the first clamp to the second clamp, a mechanism for maneuvering the second clamp back and forth between the transfer point and the final destination of the workpiece at a location past the sewing machine, and a mechanism for opening and closing the first and second clamps.

In order to reduce the cycle time of the sewing operation, the first and second clamps should be independently maneuverable. Thus, as the first clamp is returning to the initial position to be reloaded, the second clamp carries the workpiece through the sewing process to the final destination.

BRIEF DESCRIPTION OF THE DRAWINGS

The above and other objects, features and advantages of this invention will be apparent in the following detailed description of preferred embodiments, especially when taken in conjunction with the accompanying drawings.

DETAILED DESCRIPTION OF THE DRAWINGS

Figure 1:
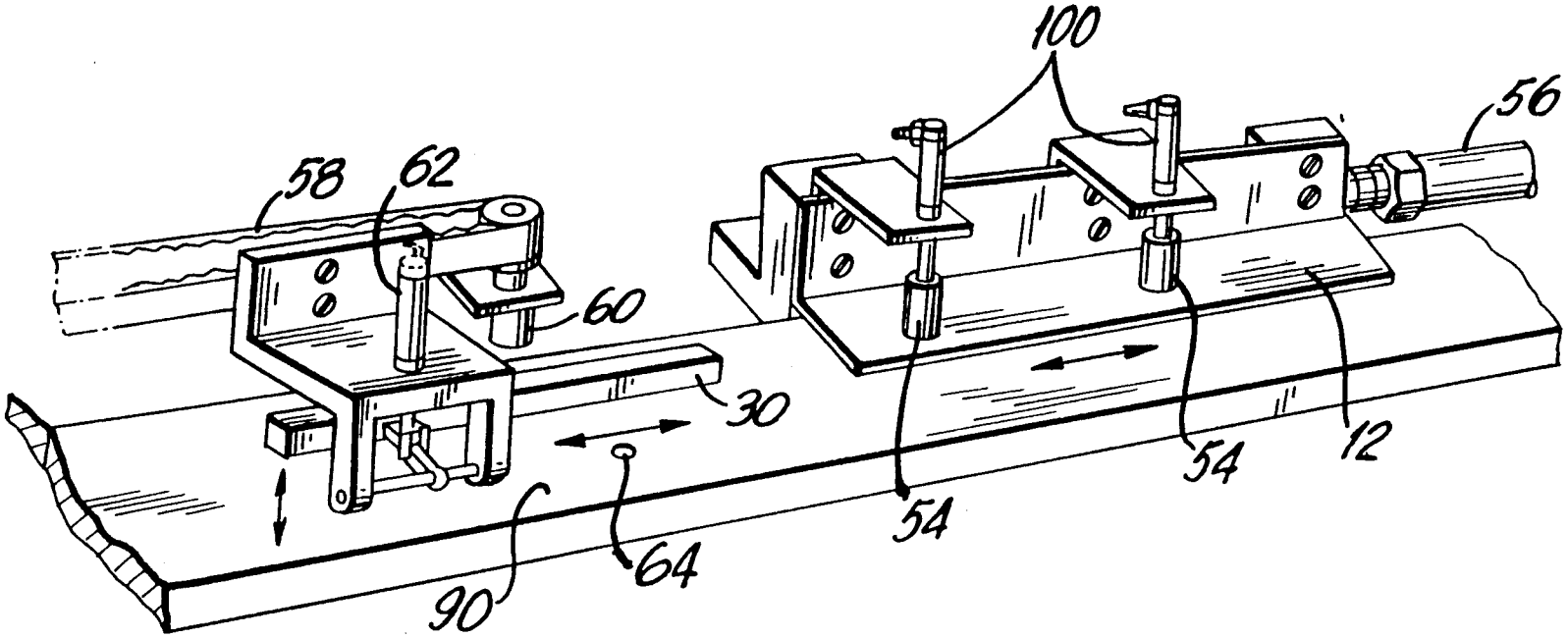
FIG. 1 is a perspective view of the mechanics of a transport system according to the invention.

Referring now to the drawings and, in particular, to FIG. 1, a preferred embodiment of the invention will be described by its method of operation. In operating this embodiment, an operator first places a workpiece on base plate 12. The workpiece is secured by engaging loading clamps 54 on top of the workpiece. The location of loading clamps 54 in relation to base plate 12 is a function of where the material should be secured to maintain the desired configuration. Although two separate loading clamps 54 are depicted in the drawing, any number of loading clamps may be used to secure the material (even one bar clamp may suffice).

After the material is secured, it is moved to a transfer point in proximity to sensor 64. The movement, in this embodiment, is induced by actuator 56 as it applies a force to base plate 12. However, any known drive system may be used for this operation.

As the clamped material moves toward the transfer point, the sewing clamp 30 moves toward the same location from a finished position. The finished position is the location that sewing clamp 30 is in after sewing clamp 30 has taken a previously loaded material through the sewing machine. Although this embodiment depicts a bar sewing clamp 30, it is possible to use other types of clamps for this operation.

Belt 58 and drive unit 60 are part of the belt drive system that maneuvers sewing clamp 30 from one position to another. Any known drive system may be adapted for this purpose. Further, although actuator 62 is depicted as the means for engaging sewing clamp 30, it should be clear that other means may be equally effective.

When sewing clamp 30 and base plate 12 reach from opposite directions, the transfer point in proximity to sensor 64, the material covers sensor 64. When the presence of the material in the transfer position is detected by sensor 64, sewing clamp 30 is engaged to secure the material against supporting structure 90 at the transfer point in proximity to sensor 64. Shortly thereafter, loading clamps 54 are disengaged. These steps result in the transfer of the material from loading clamps 54 and base plate 12 to sewing clamp 30. Sewing clamp 30 must be positioned in a fashion, in reference to base plate 12, such that loading clamps 54 and sewing clamp 30 may function without interfering with each other, but also allow for the transfer of the material without disturbing the configuration of the material.

After the transfer has been accomplished, drive unit 60 and belt 58 move sewing clamp 30 toward the finished position at the same time as actuator 56 maneuvers base plate 12 back to the loading position. The speed on drive unit 60 should be synchronized with the speed of the sewing operation such that the sewing clamp 30 pulls the material through a sewing machine at an even rate insuring proper and accurate stitching.

Automated means may also be used to position the material initially between clamps 54 and base plate 12 In addition, one skilled in the art would realize that it is not necessary to use base plate 12 if loading clamps 54 can effectively secure the material on their own, e.g., in a jaw-like fashion. The loading clamps 54 may be engaged by any known technique (e.g. by the use of actuators 100).

Figure 2:
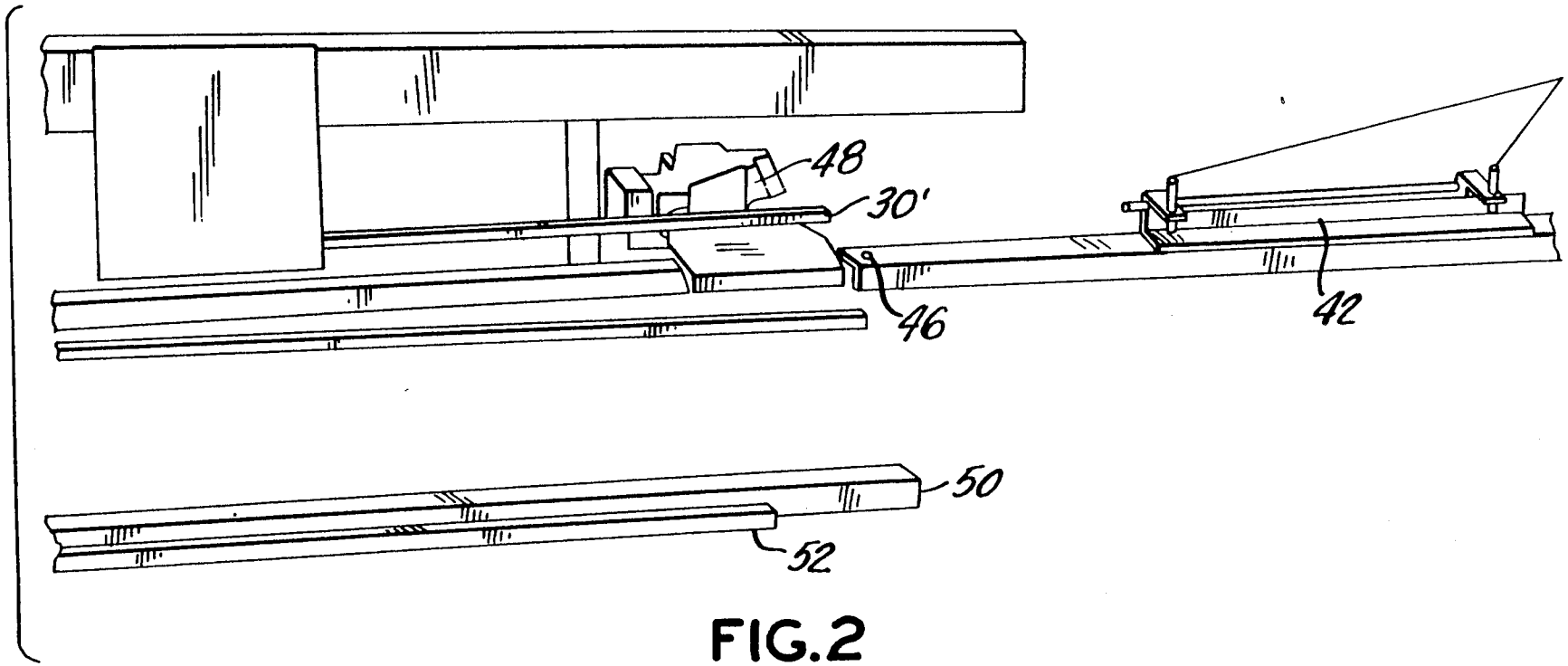
FIG. 2 is a perspective view of a transport system according to a further embodiment of the invention.

The illustration in FIG. 2 shows an overview of a clamping-transporting-sewing system, in accordance with a further embodiment of the present invention. In this embodiment, the first clamp provided at the location of loading clamp 54 in FIG. 1 may be, for example, a clamp of a pleat-forming unit. An example of such a pleat forming unit is described in the copending patent application of Takashi Miyauchi entitled "Pleating Method and Apparatus," filed the same day as the application for the present invention, Ser. No. 07/525489, the disclosure of which is incorporated by reference. The bar clamp 30, depicted in FIG. 1, corresponds to the bar sewing clamp 30' in the embodiment of FIG. 2. Sensor 46 detects when mechanism 42 and the secured materials have reached the transfer point in proximity to sensor 46. As mechanism 42 moves the materials in the appropriate direction, bar clamp 30' moves in position to secure the materials when the materials and the clamps reach the transfer point.

When the materials trigger sensor 46, bar clamp 30' is engaged, and shortly afterward, mechanism 42 is released. As mechanism 42 moves back to the loading position, bar clamp 30 guides the material through the sewing machine 48 until the necessary stitching is complete. Since the workpiece is draped across bars 50 and 52 at the end of the sewing operation, when bar clamp 30' is released, the workpiece falls over bars 50 and 52 which may then be used to carry the workpieces away from the sewing location.

Figure 3:
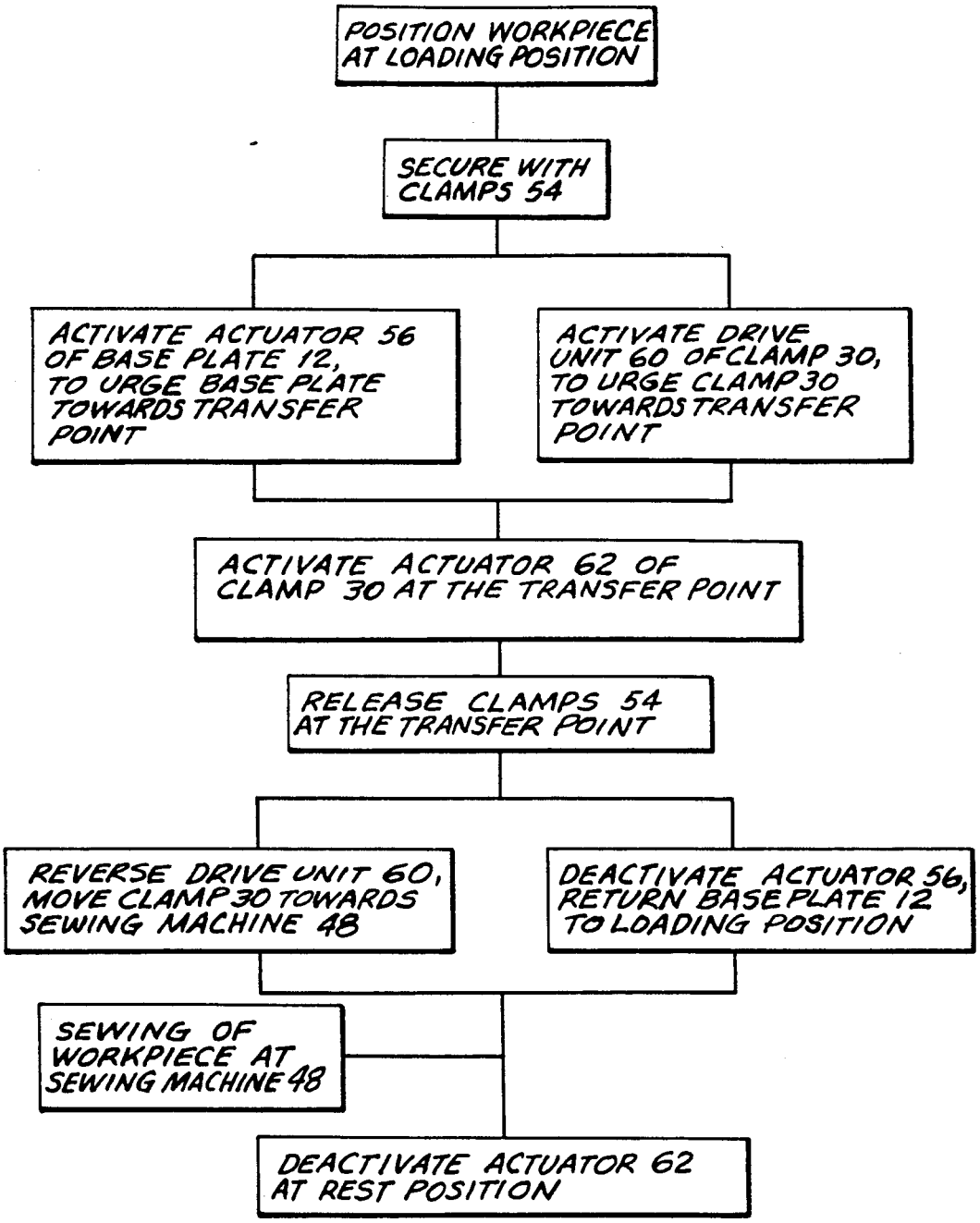
FIG. 3 is a flowchart demonstrating the operations conducted by a transport/sewing system according to the invention.

FIG. 3 is a flowchart illustrating the steps of transporting, transferring and sewing according to one embodiment of the invention. As described in the flowchart of FIG. 3, first, a clamp secures the workpiece at the loading location. The clamp is then maneuvered to a second location where the material will be transferred to another clamp as the other clamp is moving from a finished position toward the transfer location. The movement of the two clamps terminates when the first clamp is adjacent to the second, and the second clamp is poised to secure the workpiece.

The second clamp is engaged just before the first clamp is disengaging. Thereafter, the second clamp maneuvers the workpiece through a sewing machine in synchronized motion with the speed of the sewing machine in accordance with well-known techniques as the first clamp returns to the loading position.

The invention, as described in the embodiments above, may be used to transport workpieces while maintaining the desired arrangement. For example, using the embodiment described in FIG. 2, an operator may move pleated yoke-back panel assemblies from a loading location through a sewing machine while maintaining the pleated configuration during the entire transportation process by engaging of the clamping mechanism. In addition, the invention allows the operator to load a workpiece while a previously loaded workpiece is passing through a sewing machine by using two clamping mechanisms that operate independently.

Although certain embodiments have been described in detail herein, it should be noted that numerous variations may be made within the scope of the invention. The terms and expressions have been used as terms of description and not terms of limitation. There is no intention to use the terms or expressions to exclude any equivalents of features shown and described or portions thereof.

I claim:

1. A method of transporting material from a loading position past a sewing machine, comprising the steps of:

a) securing said material by a first clamp located at said loading position;

b) maneuvering said first clamp to a second position in a direction opposing a movement of a second clamp moving from a finished position toward said second position adjacent to said first clamp until said second clamp is in position to secure said material;

c) actuating said second clamp to engagedly secure said material;

d) disengaging said first clamp from securing said material; and e) maneuvering said material secured by said second clamp past said sewing machine in synchronized motion with a sewing speed of said sewing machine as said first clamp is returned to said loading position.

2. A method of transporting material from a loading position past a sewing machine, comprising the steps of:

a) positioning said material over a base plate at said loading position;

b) securing said material by a first clamp attached to said base plate;

c) maneuvering said base plate to a second position in a direction opposing a movement of a second clamp moving from a finished position toward said second position adjacent to said first clamp;

d) detecting when said material is in proper position for securing by said second clamp by the sue of a sensor;

e) securing said material with said second clamp when said material triggers said sensor;

f) disengaging said first clamp from securing said material; and g) maneuvering said material secured by said second clamp through said sewing machine in synchronized motion with a sewing speed of said sewing machine as said base plate is returned to said loading position.

3. A device for transporting material from a loading position past a sewing machine, comprising:

a) a supporting structure;

b) a first clamp movably attached to said supporting structure;

c) means for maneuvering said first clamp back and forth between said loading position and a transfer position;

d) means for engaging said first clamp against said material;

e) a second clamp movably attached to sad supporting structure;

f) means for maneuvering said second clamp back and forth between a position where said second clamp rests after said material has been passed through said sewing machine and said transfer position; and g) means for engaging said second clamp against said material

4. A device for transporting material from a loading position past a sewing machine, comprising;

a) a supporting structure;

b) a base plate slidably attached to said supporting structure;

c) a first clamp attached to said base plate that is engageable to secure said material between said first clamp and said base plate;

d) an actuator attached to said base plate wherein said actuator maneuvers said base plate back and forth between said loading position and a transfer position;

e) means for actuating said first clamp to engage said material between said first clamp and said base plate;

f) a second clamp slidably attached to said supporting structure;

g) a drive system attached to said supporting structure wherein said system maneuvers said second clamp back and forth between a position where said second clamp rests after said material has been passed through said sewing machine and said transfer position;

h) means for activating said second clamp to engage said material between said second clamp and said supporting structure; and i) means for maneuvering said second clamp in synchronous motion with a sewing action of said sewing machine.

5. A device, as recited in claim 4, where a sensor is used to determined when said material has reached said transfer point.

* * * * *

UNITED STATES PATENT AND TRADEMARK OFFICE

CERTIFICATE OF CORRECTION

PATENT NO. : 5,097,776

DATED : March 24, 1992

INVENTOR(S) : Daniel Becker

It is certified that error appears in the above-identified patent and that said Letters Patent is hereby corrected as shown below:

Column 6:

Claim 3, line 1, "sad" should be --said--;

Claim 4, line 32, "activating" should be --actuating--.

Signed and Sealed this

Twenty-first Day of September, 1993

Bruce Lehman

*Attest:*

BRUCE LEHMAN

*Commissioner of Patents and Trademarks*

*Attesting Officer*